US011717794B2

(12) United States Patent
Bublewitz et al.

(10) Patent No.: US 11,717,794 B2
(45) Date of Patent: Aug. 8, 2023

(54) MIXER

(71) Applicant: 3LMED GMBH, Marburg/Lahn (DE)

(72) Inventors: Alexander Bublewitz, Herborn (DE); Jens-Peter Reber, Meinerzhagen (DE)

(73) Assignee: 3LMED GMBH, Marburg (DE)

( * ) Notice: Subject to any disclaimer, the term of this patent is extended or adjusted under 35 U.S.C. 154(b) by 690 days.

(21) Appl. No.: 16/633,123

(22) PCT Filed: Jul. 26, 2018

(86) PCT No.: PCT/EP2018/070338

§ 371 (c)(1),
(2) Date: Jan. 22, 2020

(87) PCT Pub. No.: WO2019/020764

PCT Pub. Date: Jan. 31, 2019

(65) Prior Publication Data

US 2021/0154628 A1 May 27, 2021

(30) Foreign Application Priority Data

Jul. 28, 2017 (DE) ..... 102017117198.3
Jul. 28, 2017 (DE) ..... 102017117199.1

(51) Int. Cl.
*B01F 5/06* (2006.01)
*B01F 3/10* (2006.01)
(Continued)

(52) U.S. Cl.
CPC ..... *B01F 25/43141* (2022.01); *B01F 23/47* (2022.01); *B01F 25/4321* (2022.01);
(Continued)

(58) Field of Classification Search
CPC ..... B01F 2101/19; B01F 25/4321; B01F 25/43141; B01F 25/43161
See application file for complete search history.

(56) References Cited

U.S. PATENT DOCUMENTS 4,382,684 A 5/1983 Hori
5,487,606 A 1/1996 Keller
(Continued)

FOREIGN PATENT DOCUMENTS

DE 3606001 U1 8/1987
DE 29902666 U1 6/2000
(Continued)

OTHER PUBLICATIONS

Russian Office Action and Search Report for RU App. No. 2020104270/04 (006615).
(Continued)

*Primary Examiner* — Elizabeth Insler
(74) *Attorney, Agent, or Firm* — McDonnell Boehnen Hulbert & Berghof LLP

(57) ABSTRACT

The present disclosure relates to a mixer for mixing pasty components, comprising a mixing case extending along a longitudinal axis and having at least one inlet, preferably two inlets, and an outlet, and comprising at least one mixing element received in the mixing case, which defines a plurality of chambers together with the mixing case, said chambers being arranged successively and/or adjacently along a flow path from the inlets to the outlet. The chambers are defined by transverse walls, each extending perpendicularly to the longitudinal axis, and four side walls that each extend parallel to the longitudinal axis, and adjacent chambers are interconnected by a flow by means of through-openings provided in the side walls, the mixing element comprising two strips forming side walls, which are connected by a web that forms other side walls and is perpendicularly arranged in relation to the strips, a first group of chambers having first through-openings arranged in the web, which extend up to a strip, and a second group of chambers
(Continued)

comprising second through-openings positioned at a distance to at least one strip in the web.

14 Claims, 11 Drawing Sheets

(51) Int. Cl.

| | |
|---|---|
| ***B01F 25/4314*** | (2022.01) |
| ***B01F 23/47*** | (2022.01) |
| ***B01F 25/432*** | (2022.01) |
| ***B01F 25/431*** | (2022.01) |
| ***B01F 35/71*** | (2022.01) |
| *B01F 101/19* | (2022.01) |
| *B01F 101/00* | (2022.01) |

(52) U.S. Cl.
CPC .... *B01F 25/43161* (2022.01); *B01F 35/7164* (2022.01); *B01F 25/4314* (2022.01); *B01F 25/43162* (2022.01); *B01F 2101/19* (2022.01); *B01F 2101/2305* (2022.01)

(56) References Cited

U.S. PATENT DOCUMENTS

| | | | | |
|---|---|---|---|---|
| 6,135,631 | A | 10/2000 | Keller | |
| 6,773,156 | B2 | 8/2004 | Henning | |
| 6,837,612 | B2 | 1/2005 | Bublewitz et al. | |
| 7,997,450 | B2 * | 8/2011 | Heusser | B01F 35/71 222/137 |
| 9,522,366 | B2 | 12/2016 | Linne et al. | |
| 2001/0015936 | A1 | 8/2001 | Heusser et al. | |
| 2005/0237856 | A1 | 10/2005 | Heusser et al. | |
| 2008/0056061 | A1 | 3/2008 | Pauser et al. | |
| 2009/0296516 | A1 | 12/2009 | Keller | |
| 2010/0208544 | A1 | 8/2010 | Wintergerste et al. | |
| 2012/0199607 | A1 | 8/2012 | Keller | |
| 2013/0135963 | A1 | 5/2013 | Linne et al. | |
| 2014/0301154 | A1 | 10/2014 | Bublewitz et al. | |
| 2017/0157581 | A1 | 6/2017 | Bublewitz et al. | |

FOREIGN PATENT DOCUMENTS

| | | | |
|---|---|---|---|
| DE | 10112904 | A1 | 10/2002 |
| DE | 102004008748 | A1 | 9/2004 |
| DE | 102013222111 | A1 | 4/2015 |
| DE | 202012013429 | U1 | 1/2017 |
| EP | 0584428 | A1 | 3/1994 |
| EP | 0664153 | A1 | 7/1995 |
| EP | 0885651 | B1 | 11/2002 |
| EP | 1892033 | A1 | 2/2008 |
| EP | 1458467 | B1 | 5/2008 |
| EP | 1943012 | B1 | 1/2010 |
| EP | 2190563 | B1 | 9/2011 |
| EP | 2527029 | A2 | 11/2012 |
| EP | 2599540 | B1 | 1/2014 |
| JP | 10057791 | A | 3/1998 |
| JP | 2000-126569 | A | 5/2000 |
| JP | 2001252544 | A | 9/2001 |
| JP | 2006-515532 | A | 6/2006 |
| JP | 2017-095179 | A | 6/2017 |
| RU | 2585024 | C1 | 5/2016 |
| RU | 2588248 | C2 | 6/2016 |
| WO | 2012/116863 | A1 | 9/2012 |
| WO | 2012/116873 | A1 | 9/2012 |
| WO | 2013/026722 | A1 | 2/2013 |

OTHER PUBLICATIONS

International Search Report and Written Opinion for Int. App. No. PCT/EP2018/070344, dated Oct. 25, 2018.

* cited by examiner

FIGURE 2a (A-A)
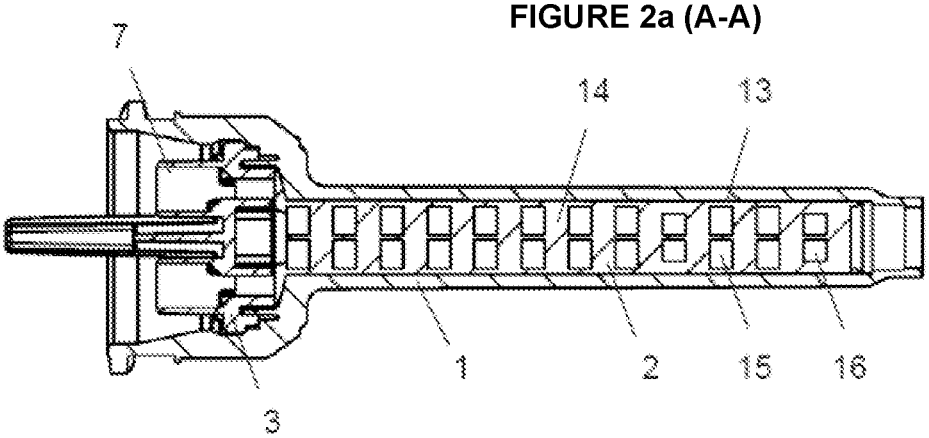
FIGURE 2b (B-B)
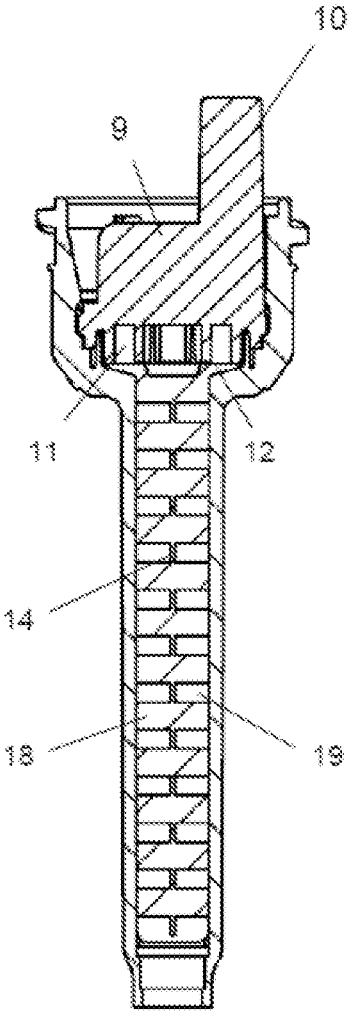
FIGURE 2c
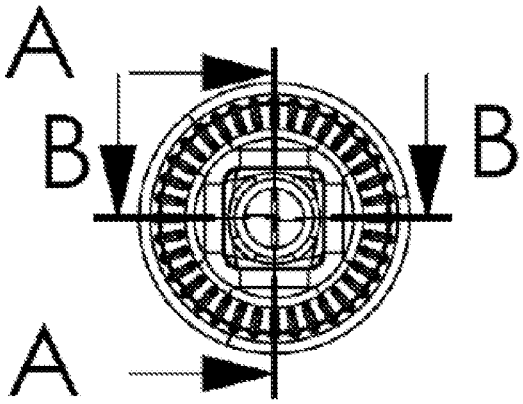

MIXER

CROSS REFERENCE TO RELATED APPLICATIONS

The present application is a U.S. National Phase Application pursuant to 35 U.S.C. § 371 of International Application No. PCT/EP2018/070338 filed Jul. 26, 2018, which claims priority to German Patent Application No. 10 2017 117 198.3, filed Jul. 28, 2017 and German Patent Application No. 10 2017 117 199.1, filed Jul. 28, 2017. The entire disclosure contents of these applications are herewith incorporated by reference into the present application.

TECHNICAL FIELD

The present disclosure relates to a mixer for the mixing of pasty and/or flowable components. The disclosure relates in particular to a static mixer, i.e., a mixer, in which the components to be mixed are mixed not by means of an actively driven mixing element, but instead flow past a mixing element and are thereby mixed.

BACKGROUND

Such types of mixers are used, among other points, for the mixing of components reacting to each other, particularly hardening components, as well as in the area of dentistry. These components are usually stored in containers or chambers of a cartridge, in which mixers can be attached solidly or in an exchangeable manner. Through the discharging of the components from the containers of the cartridge, these are conducted through the mixer and exit from this in mixed form.

Examples for such types of mixers are know from EP 0 815 929 B1, EP 1 125 626 B1, EP 1 312 409 B1, EP 1 588 757 B1, EP 2 133 138 B1, EP 2 599 540 A1, EP 2 301 656 B1, WO 2011/119820 A1, US 2017/0 036 179 A1, and EP 1 426 099 B1.

DE 10 2006 047 811 A1 describes a multi-component cartridge with a solidly connected mixer element and a discharge pipe, whereby the mixer element is formed as a guide element for the axial displacement of the discharge pipe.

Thus, a mixer with a mixing case is disclosed in EP 0 815 929 B1, which extends along a longitudinal axis and has at least two inlets and an outlet. The mixer additionally has a mixing element accommodated in the mixing case. This defines, together with the mixing case, several chambers, which are positioned along a flow path from the inlets to the outlet behind and/or next to one another. The chambers are restricted by means of transverse walls each extending to the longitudinal axis, as well as by four lateral walls, which each extend in parallel to the longitudinal axis. Adjacent chambers are flow-connected to each other by means of through-openings provided in the lateral walls. The mixers described are, however, sometimes difficult to manufacture by means of injection molding. Furthermore, it has been shown that a flowing of the components to be mixed along the lateral walls has a disadvantageous effect on the mixing result.

In this known mixer, an unsatisfactory mixing result can come about, depending on the components to be mixed, if, for example, streaks of individual components can be pulled through the entire mixer and exit from the outlet essentially unmixed.

For the improvement of the mixing result and the prevention of unmixed areas, it is proposed by EP 2 301 656 B1 to provide first flow portions and second flow portions. During the first flow, portions of the components move from the middle and into the exterior areas of the mixing element, while the second flow portions of the components move from the exterior areas into the middle of the mixing element. These flow portions should thereby reverse the direction of flow of portions of the components, but are, however, extremely expensive to manufacture.

EP 2 614 883 A1 also describes a static mixer, which has an improved mixing result. For that purpose, so-called separating elements are positioned on the radial outer sides of the mixing element in addition to deflection elements, whereby the separating elements are inwardly oriented in the radial direction.

This should compensate different flow speeds of the components in the mixing element.

A mixer is known from EP 2 133 138 B1, which has a first series of mixing elements for the portions of the flows of components in a first direction, and a second series of mixing elements for the portions of the flows of components in a second direction.

A mixer known from EP 1 125 626 B1 has several modifications of a rectangular base structure of mixing chambers that have inlets and outlets. One modification has a web inclined to the axis of the tube, which connects one inlet in a mixing chamber with an outlet in such a way that the through-flowing of the web of the wall of the tube in the direction of the axis of the tube or vice versa is deflected from the axis of the tube and into the direction of the wall of the tube. Alternately, the lengths of three adjacent chambers can also be shortened, so that the number of inlets or outlets is reduced. The three modified chambers thereby formed are positioned in such a way that a pair of chambers, which are positioned along the axis of the tube one behind the other, form two of these chambers, and a third chamber, which is positioned laterally from the pair of chambers, produces a connection between both chambers of the pair through two openings.

The mixers noted above have very complexly designed mixing elements for the solution of the problem of the formation of streaks which are correspondingly expensive and costly in their manufacture. Such mixers are, therefore, only contingently suitable for areas of application in which the components mixed with each other harden out and the mixer is therefore used as a disposable product.

SUMMARY

Proceeding from this basis, it is an object of the present disclosure to provide a mixer of the type described above, which has a simple construction and makes possible a thorough mixing pasty and/or flowable components.

This object is essentially solved by means of a mixer in accordance with claim 1. The mixer thereby has, in particular cuboid, chambers, which are positioned behind and next to one another and are connected with one another by means of through-openings. The components flow through some of the chambers along a flow path from the inlets to the outlet, i.e., along the path of the components through the mixer, and are thereby mixed with one another.

In accordance with a first aspect of the present disclosure, the mixing element thereby has two strips each forming, in particular essentially closed, lateral walls and run, in particular in parallel to one another or running towards one another, at a distance away from one another and in the direction of the longitudinal axis of the mixer. Here, the strips are connected by way of an additional web forming lateral walls and positioned perpendicularly to the strips. The strips thereby preferably form radially, i.e. proceeding from the central point or focal point and projecting laterally away from the longitudinal axis of the mixer, outer lateral walls of the chambers, on which [lateral walls] the internal wall of the mixing case may abut. On the other hand, the web may, as a separating element proceeding in parallel to the longitudinal axis, divide the mixing chamber of the mixing case into two areas. The strips and the web are thereby preferably positioned in relation to one another in such a way that they form an H-shaped cross-section (perpendicularly to the longitudinal axis), whereby the web connects the strips, particularly centrally. This base structure of the mixing element with two strips and one web can be produced, for example by means of injection molding, in a comparatively simple and economical manner. At the same time, this construction brings it about that the mixing element is formed in a comparatively rigid and stable manner, which facilitates the mounting of the mixing element in the mixing case.

In accordance with an additional aspect of the disclosure, a first group of chambers, also chambers of the first group, has first through-openings positioned in the web which extend up to the strips, and a second group of chambers, also chambers of the second group, has second through-openings which are positioned at a distance from at least one strip in the web. In other words, the first through-openings extend up to a radial outer area of the mixing chamber formed by the mixing case which radial outer area is defined by one of the strips, whereas the second through-openings are, due to their arrangement spaced from one of the strips, displaced radially inwardly in the mixing chamber. Through this different arrangement of the through-openings, streaks of the components to be mixed can be effectively prevented from being pulled through the outer area of the mixing chamber in unmixed form up to the outlet. In particular, the first through-openings are designed in such a way that they extend, if applicable interrupted by an additional lateral wall, over the entire width of the mixing chamber from one strip up to the other strip. The second through-openings may, for example, be designed in such a way that they extend, again if applicable interrupted by an additional lateral wall, over a radial internal area of the mixing chamber at a distance from both strips.

The transverse walls are preferably connected with the web and one of the strips. The transverse walls thereby do not extend, in accordance with one embodiment, over the entire width of the web but, instead only one of the strips up to the middle of the web, for example. Through this, approximately one quarter of the cross-section of the mixing chamber is sealed in the direction of the longitudinal axis. Transverse walls can be provided on both sides of the web in a cross-sectional plane of the mixer, i.e., at the same position along the longitudinal axis. It is preferable if the transverse walls are positioned displaced to one another, i.e., if a transverse wall extends to one side of the web of one of the strips up to the middle of the mixing chamber and an additional transverse wall extends to the other side of the web from the other strip up to the middle.

Additional lateral walls of the chambers can extend from the transverse walls in the direction of the inlets, i.e., against the direction of flow of the components, parallel to the strips. These additional lateral walls are preferably positioned centrally on the web, in order to once again divide the halves of the mixing chamber divided by the web up to one fourth of the mixing chamber, for example. In this design of the mixing element, one of the through-openings is preferably provided in the web in the area along the longitudinal axis in which these additional lateral walls are provided. On the other hand, through-openings are provided in the additional lateral walls in the area along the longitudinal axis in which the web is closed, for example.

In accordance with one preferred embodiment, the chambers of the first group and the chambers of the second group each have precisely four through-openings from which two through-openings are formed in the web and two additional through-openings extend in parallel to the web into the additional lateral walls so that the through-openings proceeding in parallel to the web, in particular, open up a direction of flow proceeding in parallel to the web. In other words, in these chambers, the through-openings, which are preferably all positioned displaced to one another along the longitudinal axis, are positioned in directions perpendicular to the longitudinal axis and to one another. A mixing of the components thereby takes place through the entrance of the components into the corresponding chamber from chambers that are positioned in different quadrants corresponding to the chambers (considered in a cross-section perpendicular to the longitudinal axis) and through the exit of the components from the corresponding chamber into chambers that are positioned in the different quadrants corresponding to the chamber (considered in a cross-section perpendicular to the longitudinal axis). In particular, the two through-openings formed in the web are provided as recesses in the web, while the two additional through-openings proceeding in parallel to the web can be provided as recesses in the walls proceeding perpendicularly to the web.

Known mixers sometimes have the problem that, at the beginning of the mixing process, one of the components enters into the mixing chamber faster or in excessive quantity, so that an initial quantity of the mixture does not consist of the desired mixture ratio of the components. This problem can thereby be countered, among other ways, in such a way that the mixing case and the mixing element form a third group of at least one chamber, which has closed lateral walls as a reservoir chamber and only one opening that is formed as an inlet opening in a transverse wall. An initial quantity of the components flowing into the mixer can be collected in this reservoir chamber, so that subsequent quantities of the components, which then mostly have the correct mixture ratio, are then mixed in the mixer and discharged from it. Since the reservoir chamber in accordance with the disclosure has only one inlet opening, but is not otherwise flow-connected with the other chambers, however, the components entering into the reservoir chamber are held there, so that these essentially no longer participate in the additional mixing process.

It has proven to be particularly appropriate if at least one reservoir chamber is provided in the inlet-side end of the mixing element. In this configuration, the faster-moving component is not conducted through the other chambers. In the division of the mixing chamber into four quadrants as described above by way of example (considered in a cross-section perpendicular to the longitudinal axis), for example, two quadrants offset from one another can be provided with reservoir chambers, while chambers of the first group or second group are provided in both other quadrants.

The mixing case and the mixing element each preferably form four chambers positioned next to one another in cross-section. In principle, however, even more than four chambers may even be positioned next to one another.

The mixing case may have a first section that is rectangular in cross-section, in which the mixing element is accommodated, and may have a second section circular in cross-section, on which the outlet is provided. Even the end of the mixing case connectable with a cartridge may have a section circular in cross-section, for example. This cartridge-side section may be provided with connecting means for the fastening of the mixer to the cartridge by means of bayonet elements or a threading, particularly an external thread section, for example.

The mixing case preferably has an inlet section, in which an insert, which has at least two studs forming the inlets, is fixed in the axial direction in a sealed manner. The sealing of the insert against the mixing case may thus take place in such a way that the insert is pressed into the mixing case more firmly if the discharge pressure increases. Circumferential lips, which are applied more strongly to a sealing surface in a sealing manner, depending on the internal pressure in the mixer may also be provided. If the insert is freely rotatable against the mixing case, then the studs of the insert can engage with corresponding studs or openings of the cartridge, without impeding a relative rotation of the mixing case that is possibly necessary for the fastening of the mixer in the cartridge.

The studs of the insert are preferably flow-connected with the chambers by means of channels forming at least one compensation chamber and/or running at least partially radially inwardly. The arrangement and design of the channels may thereby likewise contribute to solving or minimizing the above-described problem of known mixers with a component moving faster at the beginning.

If necessary, several first groups of chambers and several second groups of chambers may also be positioned in the mixing element. It has proven to be favorable, in particular, to provide one to three first groups and one to three second groups of chambers in the mixing element.

It is furthermore preferable to arrange the first group of chambers and the second group of chambers, considered in the direction of discharge of the components, in the upper and/or the middle areas of the mixing element. In other words, the first and the second group of chambers are positioned in the range of above 50% or above 70% axial length of the mixing element, again considered in the direction of discharge of the components. Particularly preferably, the first and the second group of chambers are positioned in the range of 50 to 95% of the length of the mixing element, again considered in the direction of discharge of the components.

It is additionally preferable if the mixing element has a flow chamber adjacent to the reservoir chamber, in which the flow chamber has a through-opening proceeding parallel to the web. It is particularly preferable if the cross-section of the flow chamber positioned perpendicularly to the direction of discharge of the material amounts to 80% to 120% of the cross-section of the through-opening of the flow chamber. This improves the flow behavior of the components in the area of the reservoir chamber and of the flow chamber, because an increased pressure build-up does not come about in the area of the through-opening. In addition, the length of the mixer, for example, can be adjusted in its entirety or in some sections in the direction of discharge of the material, which influences the cross-section of the through-opening. In particular, the entire length of the mixer can be increased, which likewise increases the cross-section of the through-opening.

Alternately, or in supplement to this, the blocking chamber can also be shortened in the direction of discharge of the material, which likewise increases the cross-section of the through-opening.

In continuation of this line of thought, it can be provided that the flow chamber is restricted in the direction of discharge of the material by a transverse wall and that the transverse wall comprises a transverse wall opening, so that the components can at least partially flow in through the transverse wall opening. This reduces the discharge pressure upon the discharge of the components through the mixer, which leads to a greater user-friendliness when discharged.

It is furthermore preferable if the cross-section of the mixing element positioned perpendicularly to the longitudinal axis in the section of the reservoir chamber and/or flow chamber amounts to 105% to 150%, preferably 105% to 120%, particularly preferably to 110%±5%, of the cross-section of the mixing element positioned perpendicularly to the longitudinal axis considered in the direction of discharge of the material of the following section of the mixing element. In other words, the mixing element is increased in an area of the reservoir chamber and/or flow chamber. This leads to the fact that a higher cross-section of flow can be achieved in this area with constant stability of the mixing element, which is advantageous for the reduction of the discharge pressures, particularly for highly viscous components. Furthermore, the holding capacity of the reservoir chamber is improved, so that a large-volume forerun can be accommodated.

The reservoir chamber and/or flow chamber are preferably provided in the section that is covered with the inlet section of the mixing case, which has the advantage that an expansion of the mixing element can be accommodated in this section by means of a corresponding adjustment of the internal contour of the inlet section of the mixing case. Otherwise, the mixing case can, of course, even be adjusted corresponding to the expanded contour of the mixing element.

BRIEF DESCRIPTION OF THE FIGURES

The disclosure will be explained in further detail in the following by means of exemplary embodiments and with reference to the diagrams. All the characteristics described and/or graphically represented thus form the object of the disclosure, either by themselves or in any desired combination, independently of their summary in the claims or in their referrals back to the same.

The following are depicted schematically:

FIG. 2*a* shows the mixer in accordance with FIG. 1*a* in a sectional view, FIG. 2*b* shows the mixer in accordance with FIG. 1*a* in an additional sectional view, FIG. 2*c* shows the mixer in accordance with FIG. 1*a* in a view from above, FIGS. 6*a*, 6*b* and 6*c* show a perspective view (FIG. 6*a*), a side view (FIG. 6*b*), and a longitudinal section (FIG. 6*c*) along the section plane A-A of a fourth mixing element, FIGS. 7*a*, 7*b* and 7*c* show a perspective view (FIG. 7*a*), and a side view (FIG. 7*b*), and a longitudinal section (FIG. 7*c*) along the section plane B-B of a fifth mixing element, FIGS. 8*a*, 8*b* and 8*c* show a perspective view (FIG. 8*a*), and a side view (FIG. 8*b*), and a longitudinal section (FIG. 8*c*) along the section plane C-C of a sixth mixing element, FIGS. 9*a*, 9*b* and 9*c* show a perspective view (FIG. 9*a*), and a side view (FIG. 9*b*), and a longitudinal section (FIG. 9*c*) along the section plane D-D of a seventh mixing element, FIGS. 10*a*, 10*b* and 10*c* show a perspective view (FIG. 10*a*), and a side view (FIG. 10*b*), and a longitudinal section (FIG. 10*c*) along the section plane E-E of an eighth element, and:

FIGS. 11*a*, 11*b* and 11*c* show a perspective view (FIG. 11*a*), and a side view (FIG. 11*b*), and a longitudinal section (FIG. 11*c*) along the section plane F-F of a ninth mixing element.

DETAILED DESCRIPTION

Figure 1A:
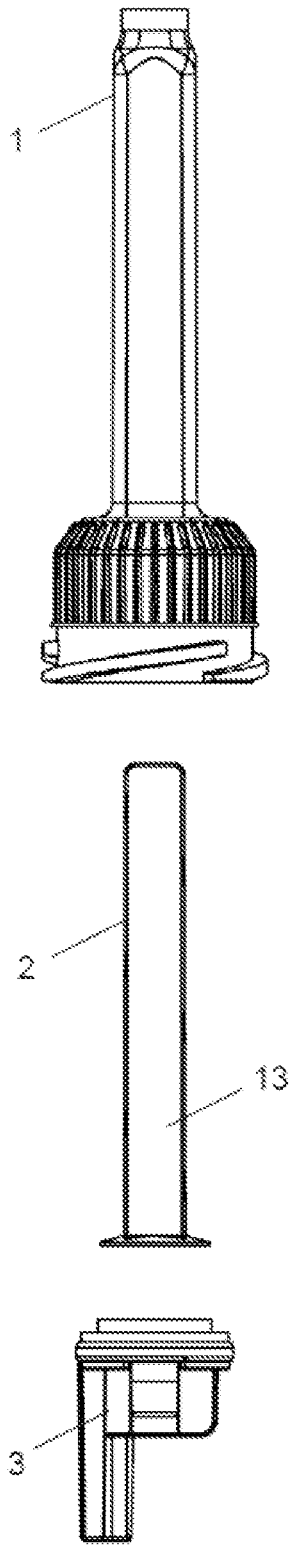
FIG. 1*a* shows the individual parts of a mixer in accordance with the disclosure in accordance with a first embodiment in a side view.

The static mixer depicted in the first embodiment in accordance with FIGS. 1*a* to 3 is essentially constructed from three components, namely, a mixing case 1, a mixing element 2, and an insert 3.

The mixing case 1 is an extended component, which extends along a longitudinal axis L. The mixing case 1 has, in FIGS. 1*a* to 1*c*, a lower intake area 4 with an essentially circular cross-section, a middle area with rectangular cross-section, one mixing chamber 5, and a discharge end 6, which again has an essentially circular cross-section. The intake area 4 can, as indicated in the embodiment depicted, be provided with a thread section or the like or fastening means for the connection of the mixer with a cartridge, as well as with an outer profiling.

The insert 3 is accommodated in the intake area 4 in a freely rotatable but axially solid manner, however, and by means of latching, for example. The insert 3 is provided with two studs 7, which form inlets of the mixer. The discharge end 6 positioned opposite the insert 3 is provided with an outlet 8. In the embodiment depicted, a partition wall 9 is formed between the studs 7, which wall is provided with a coding element 10 projecting over the mixing case 1, which coding element may, in a manner not further depicted, engage with a cartridge in a corresponding opening of the cartridge for the guiding of the mixer during the production of the connection. The studs 7 are flow-connected with the mixing chamber 5 by means of partially radial or arc-shaped inwardly leading channels 11.

Figure 1B:
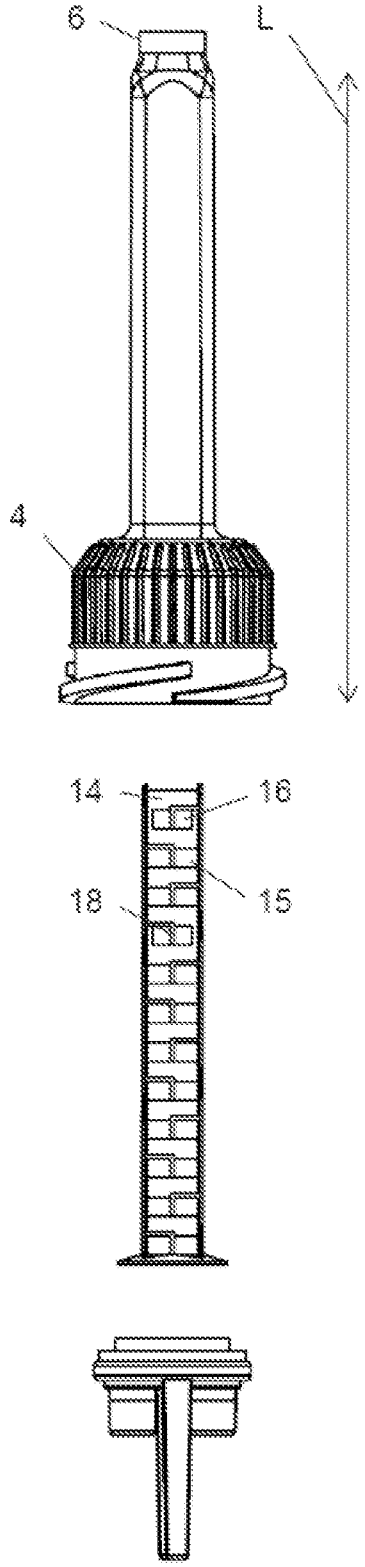
FIG. 1*b* shows the individual parts of the mixer in accordance with FIG. 1*a* in an additional side view.
Figure 1C:
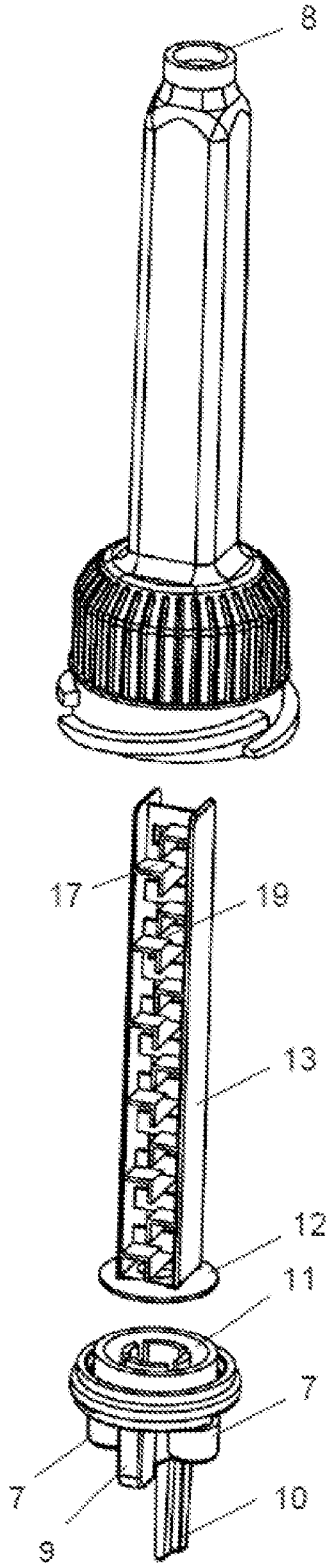
FIG. 1*c* shows the individual parts of the mixer in accordance with FIG. 1*a* in a perspective view.
Figure 3:
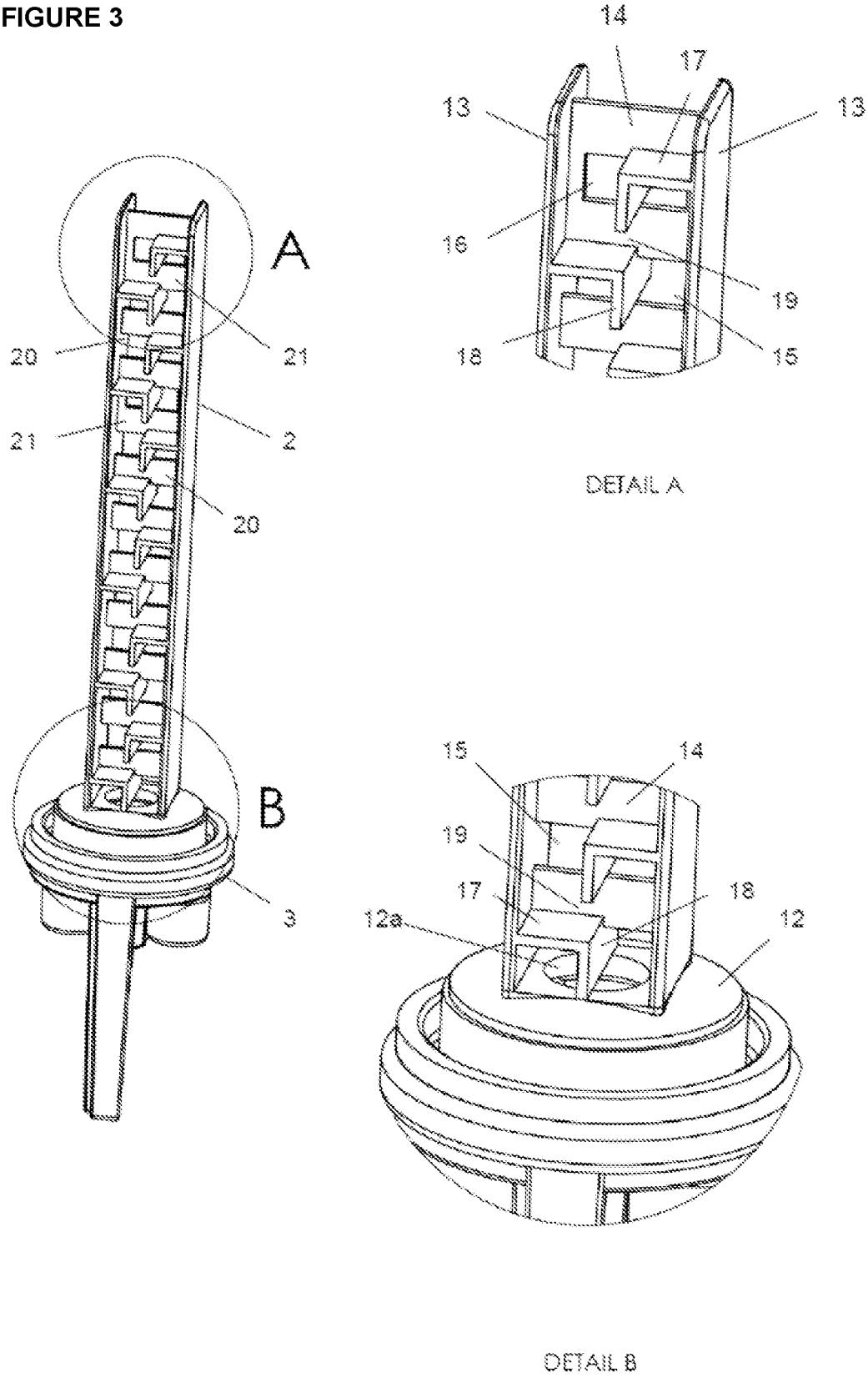
FIG. 3 shows a perspective view, components of the mixer in accordance with FIG. 1*a* with increased details.

The mixing element 2 is accommodated in the rectangular section of the mixing case 1 and has, on its lower end in FIGS. 1*a* to 1*c*, a plate 12 with a central intake aperture 12*a*, through which the components to be mixed arrive from the channels 11 into the mixing chamber 5. In particular, the mixing element 2 is insertable into the mixing case 1 and is held by means of the plate 12 in the axial direction in such a way that a displacement of the mixing element 2 in the direction of the discharge end 6 of the mixing case 1, such as, for example, through the discharge pressure of the components, is prevented. Two strips 13 of the mixing element 2, which are connected with one another by means of a web 14, which is designed in an H-shape in a cross-section perpendicular to the longitudinal axis L the mixing element 2, extend parallel to the longitudinal axis L. The strips 13 extend, in the embodiment depicted, over the entire width of the mixing chamber 5 into the area of the mixing case with a rectangular cross-section.

The web 14 is provided with several through-openings, which are rectangular in the embodiment depicted. The first through-openings 15 thus extend over the entire width of the web 14 and thereby adjoin both strips 13. The second through-openings 16, on the other hand, do not extend over the entire width of the web 14 and are thereby positioned spaced from the strips 13. This is also evident from FIG. 2*a* and the enlarged detail A of FIG. 3.

Several transverse walls 17 offset to one another in the direction of the longitudinal axis L are formed against the web 14, which [traverse walls], in the embodiment depicted, extend from one of the strips 13 up to approximately the middle of the web 14. In a cross-sectional plane perpendicular to the longitudinal axis L, a first transverse wall 17 is present on one side of the web 14, whereas a transverse wall 17 offset to the first transverse wall is provided on the other side of the web 14. In other words, for example, in the increased detailed view in FIG. 3, the forward transverse wall 17 is connected with the right strip 13, whereas the transverse wall 17 provided on the rear side of the web 14 is connected with the left strip 13.

Lateral walls 18 extend from the transverse walls 17 in parallel with the longitudinal axis L and perpendicularly to the web 14 at the bottom of the figures, i.e., in the direction towards the intake area 4 of the mixer. These lateral walls 18 do not extend in the axial direction up to the following transverse wall 17, but are instead interrupted by additional through-openings 19, whereby the through-openings 15, 16 and the through-openings 19 are positioned in the direction of the longitudinal axis L offset to one another in such a way that the through-openings 19 are provided in the areas in which the web 14 is closed, i.e., where there are no through-openings 15, 16. On the other hand, the through-openings 15, 16 are positioned in the areas in which no through-openings 19 are present in the lateral walls 18.

The mixing case 1, the strips 13, the web 14, the transverse walls 17, and the lateral walls 18 thus define the chambers 20, 21, which are flowed through by the components to be mixed on the flow path from the inlets to the outlet. The length of the chambers 20, 21 in the direction of the longitudinal axis L is defined by the distance of two transverse walls 17 positioned in parallel one behind the other to the longitudinal axis L. The chambers essentially differ through the differences of the through-openings 15, 16 in the first chambers 20 and the second chambers 21, as well as through their arrangement within the mixer. Adjacent chambers are thus positioned in the direction of the longitudinal axis L offset in relation to one another by a half chamber length.

In this arrangement, each of the chambers is provided with two through-openings 15 or 16, respectively, and with two through-openings 19. Each of the chambers is thus flow-connected, by means of the through-openings 15 or 16, respectively, with a chamber backwardly offset along the longitudinal axis L by half a chamber length and by half a chamber length on the other side of the web 14. In addition, each chamber is connected in a flow-connected manner by way of the through-openings 19 with a chamber backwardly offset along the longitudinal axis L by half a chamber length and a chamber forwardly offset by half a chamber length on the same side of the web 14. Each chamber is thereby connected by way of the four through-openings 15, 16, 19 with four different other chambers. The deflection, splitting into partial streams, and merging of the partial streams of the components during the through-flow of the different chambers thereby brings about an intensive mixing of the components.

In addition to these chambers 20, 21 designed essentially equally in their construction, there are also corresponding incomplete chambers with only one or with only two through-openings present in the area of the inlet end and of the outlet end of the mixer.

Figure 4A:
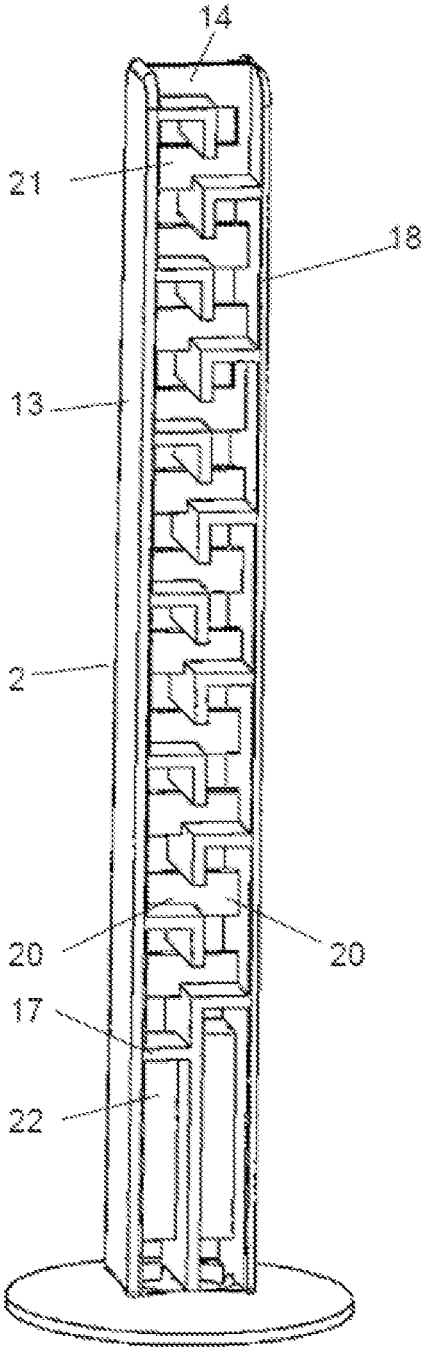
FIG. 4*a* shows the mixing element of a mixer in accordance with a second embodiment of the disclosure in a perspective view.
Figure 4B:
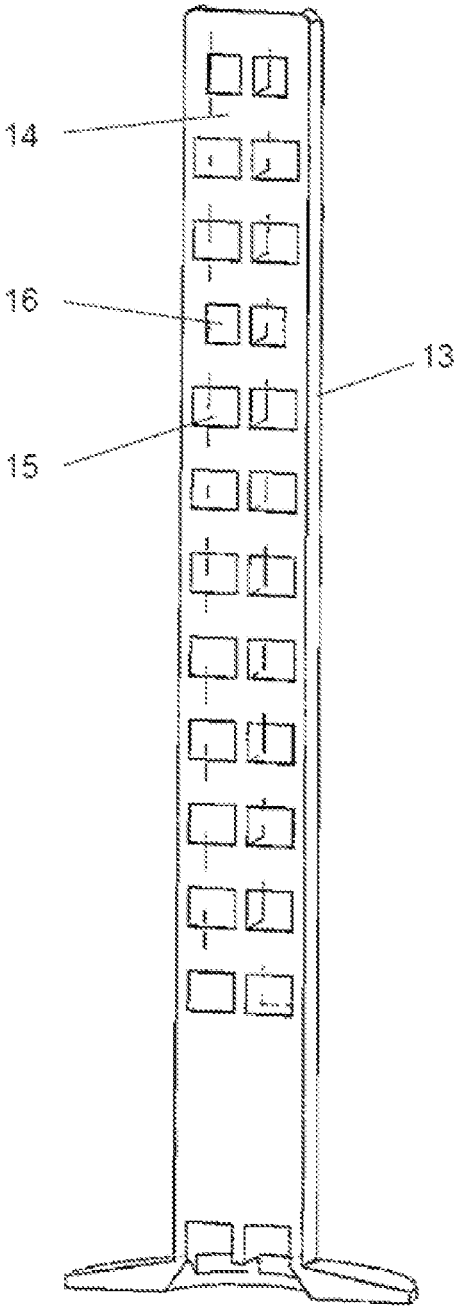
FIG. 4*b* shows the mixing element in accordance with FIG. 4*a* in a sectional view.

In the second embodiment of FIGS. 4*a* and 4*b*, the mixing element 2 is modified relative to the first embodiment in such a way that reservoir chambers 22, which have only one inlet, but no outlets, however, are formed in the vicinity of the plate 12. In these reservoir chambers 22, the initial quantity of a component tending to forerunning can still be collected and stored before entering into the chambers 20, 21, without this initial quantity participating in the additional mixing process.

Figure 5:
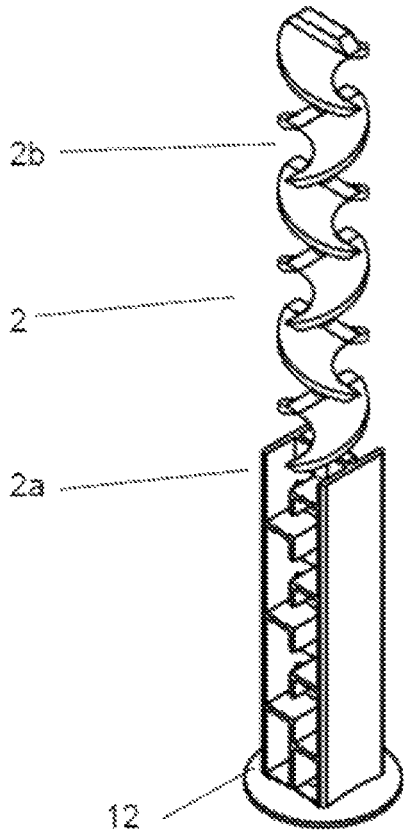
FIG. 5 is a perspective view of a mixer with a third mixing element, an insert, and a mixing case.

A third embodiment of the mixing element 2 is depicted in FIG. 5. In comparison with the above-described embodiments, the mixing element 2 depicted here comprises both a rectangular area 2*a* as well as a helical area 2*b*, which connects in the direction of discharge of the components with the rectangular area 2*a*. This has the advantage that the length of the mixing element 2 can be adjusted to the respective application requirements. Because the rectangular area 2*a* has good mixing properties, but also a high discharge pressure, while the helical area 2*b* provides a lower discharge pressure, the mixing effect, the length, and the output pressure on the respective application requirements can be adjusted through the adjustment of the lengths of the rectangular area 2*a* and of the helical area 2*b*.

FIGS. 6*a* to 11*c* depict additional embodiments of a mixing element 2 with a reservoir chamber 22. The components to be mixed can flow in through the intake opening 12*a* provided centrally in the collar 15 from the insert 3 (not depicted).

Figure 6A:
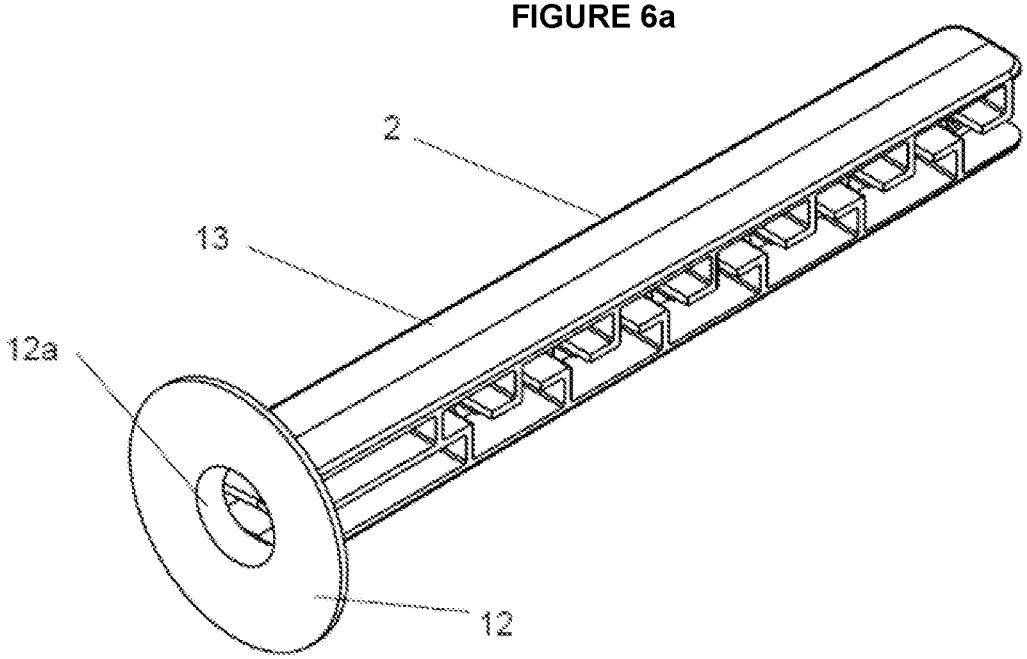
Figure 6B:
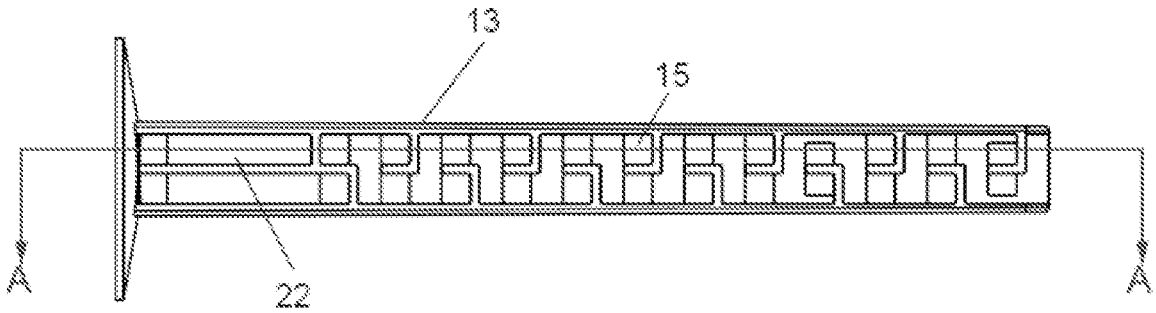
Figure 6B:
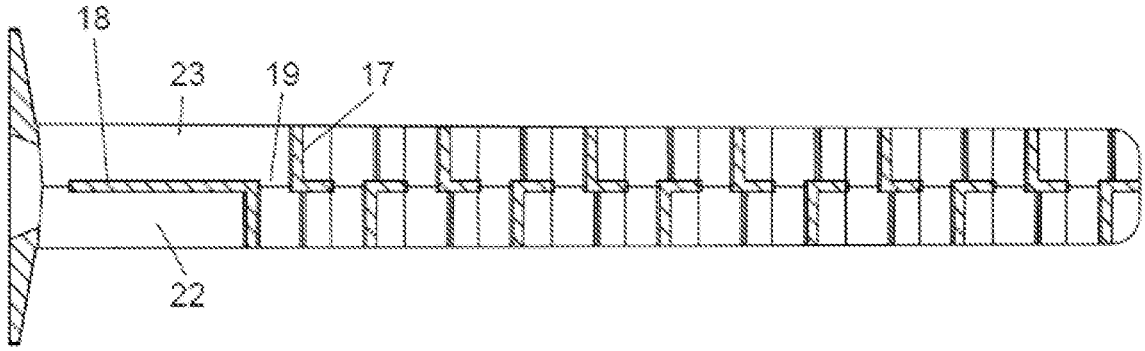

FIGS. 6*a* to 6*c* depict a mixing element 2 in accordance with a fourth embodiment. Considered from the longitudinal view of FIG. 6*b*, the arrangement of the reservoir chamber 22 of the first portion of the mixing element 2 can be seen in the direction of discharge of the material. In addition, the section plane A-A is depicted, while the corresponding longitudinal section is depicted in FIG. 6*c*.

Upon the flowing of the components in through the intake opening 12*a*, these are divided on a lateral wall 18 and flow partially into a reservoir chamber 22 and partially into a flow chamber 23. The components flow from the flow chamber 23 through a through-opening 19 to the chambers 20, 21 of the mixing element 2.

In the fourth embodiment depicted here, the cross-section of the through-opening 19 is smaller than the cross-section of the flow chamber 23. The smaller cross-section, and here, therefore, the cross-section of the through-opening 19, is thus decisive for the drop in pressure upon the discharge of the components.

Relatively high discharge pressures can thereby appear, whereby the discharge pressure is also influenced by the configuration of the mixing element 2 and the specific viscosity of the components.

Figure 7A:
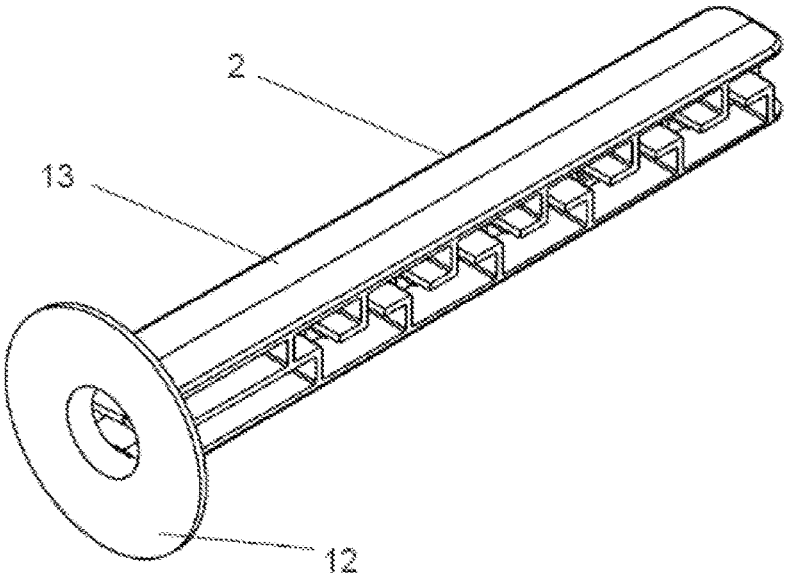
Figure 7B:
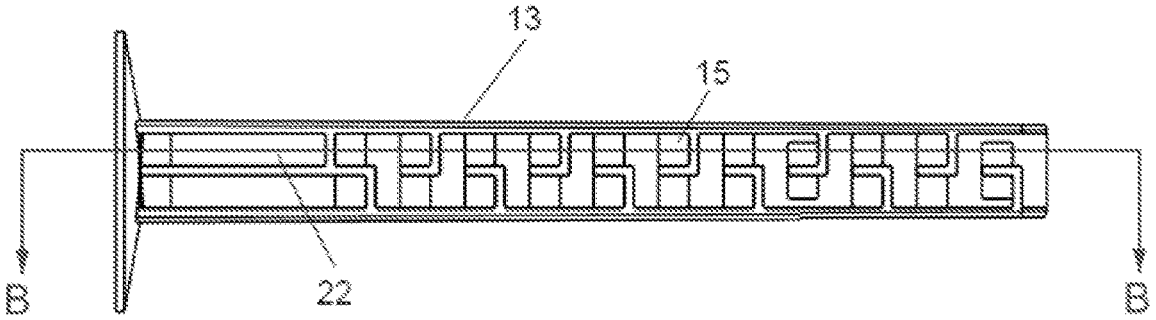
Figure 7B:
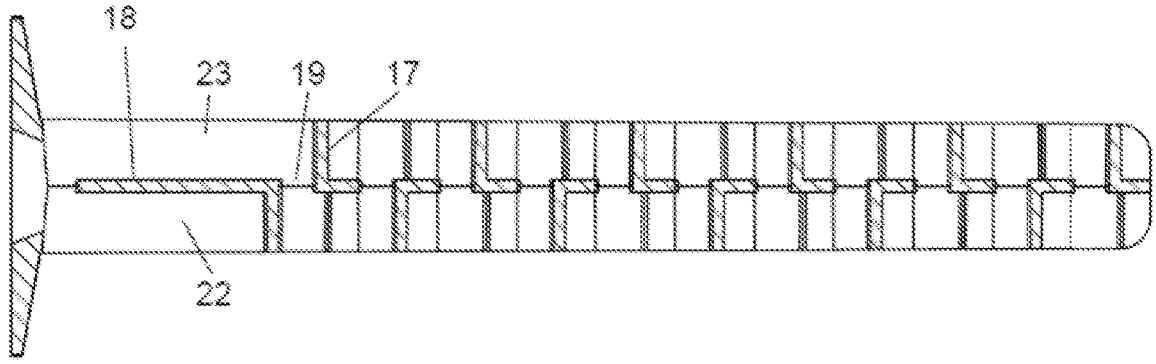

A fifth mixing element 2 is depicted in FIGS. 7*a* to 7*c* in a perspective view, in a side view, and in a longitudinal section along the section plane B-B. In comparison with the example depicted in FIGS. 6*a* to 6*c*, the mixing element 2 was shortened on its end positioned in the direction of discharge of the material. This reduces the discharge pressure, so that this embodiment for components is suitable upon higher viscosity.

Figure 8A:
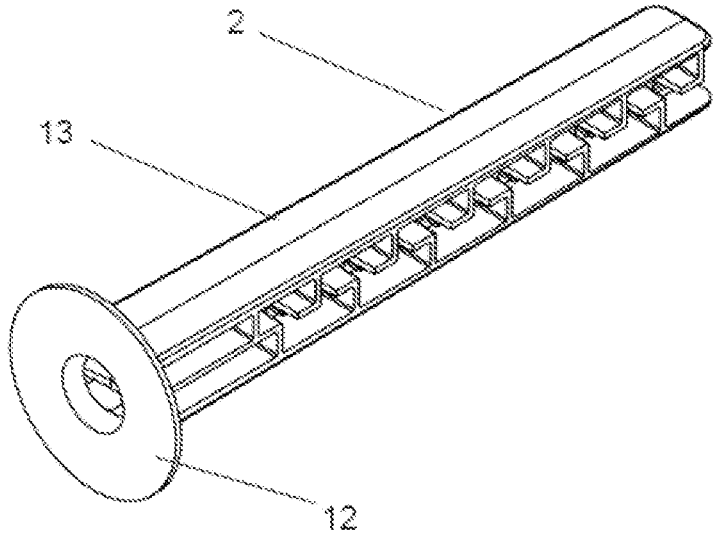
Figure 8B:
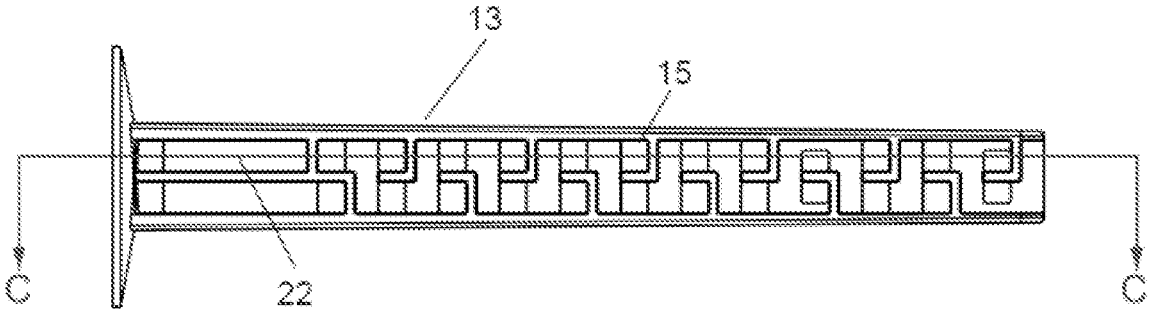
Figure 8B:
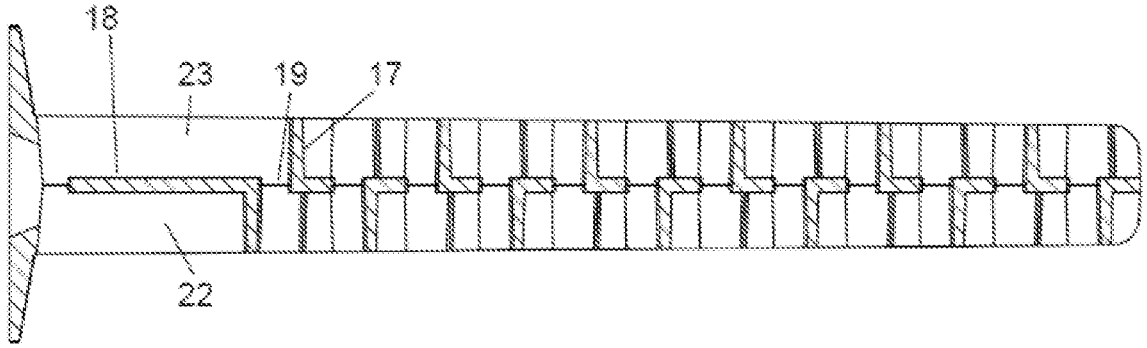

FIGS. 8*a* to 8*c* depict a mixing element 2 in a sixth embodiment. In comparison with the fourth embodiment, the draft angles in accordance with FIGS. 6*a* to 6*c* were increased here on the open sides of the mixing element. The draft angles have, in particular, an angular range of 0.1° to 2°, preferably 0.1° to 1° and, particularly preferably, up to 0.5°±0.1°.

Figure 9A:
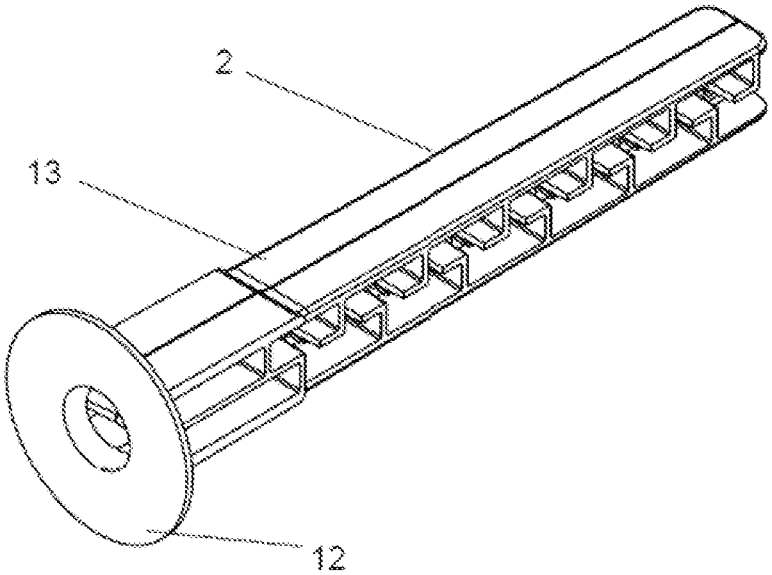
Figure 9B:
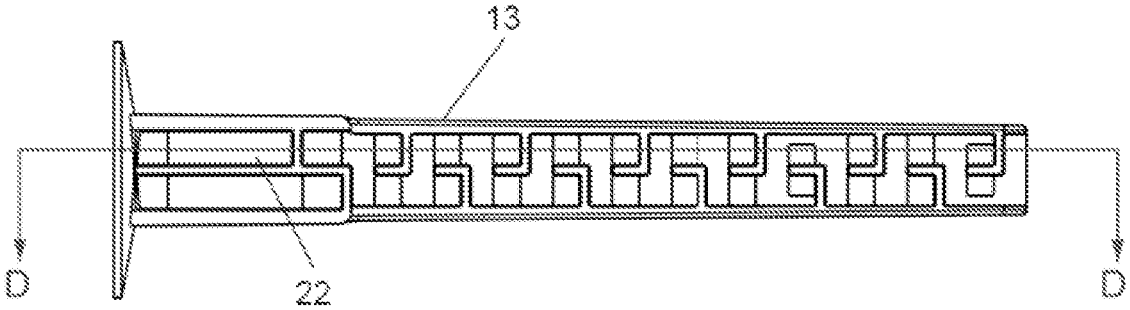
Figure 9B:
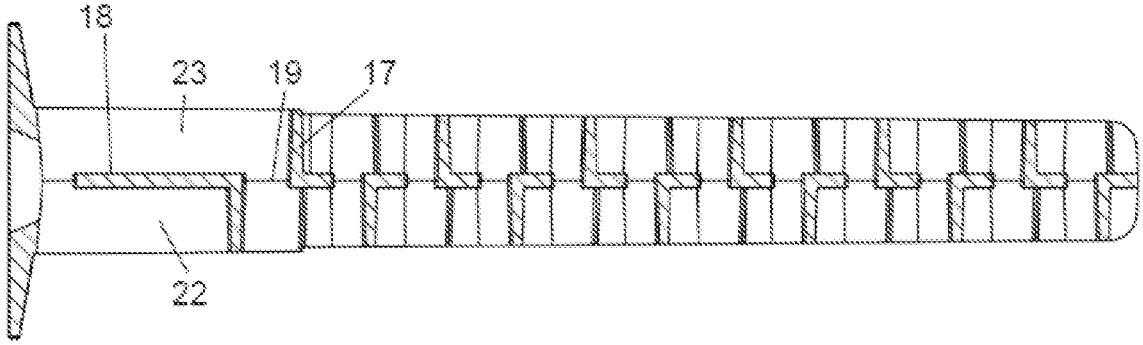

A seventh mixing element, which has been widened in the area of the reservoir chamber 22 and of the flow chamber 23, is depicted in FIGS. 9*a* to 9*c*. Through that fact, the pressure is reduced when the components are discharged, because the cross-section of flow has been increased overall in this area. This embodiment is therefore particularly advantageous for highly viscous components. In addition, the volume of the reservoir chamber 22 has been increased, so that even more forerun can be compensated for.

Figure 10A:
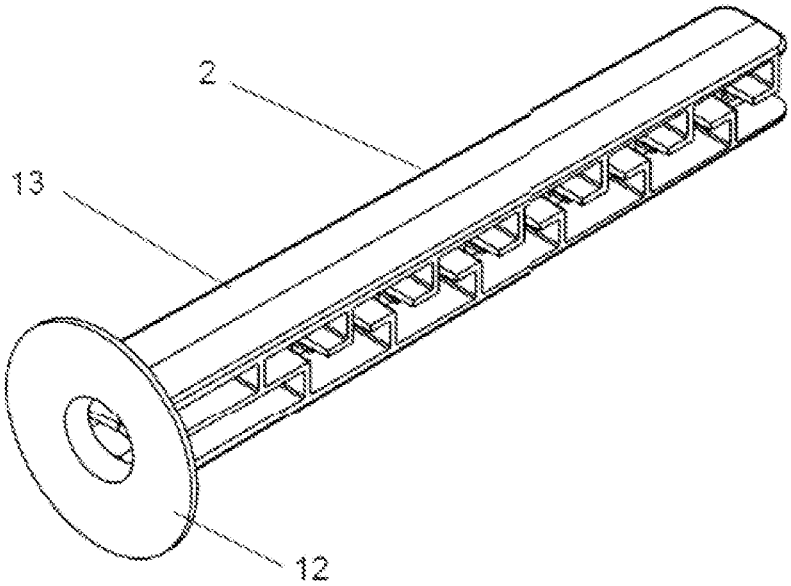
Figure 10B:
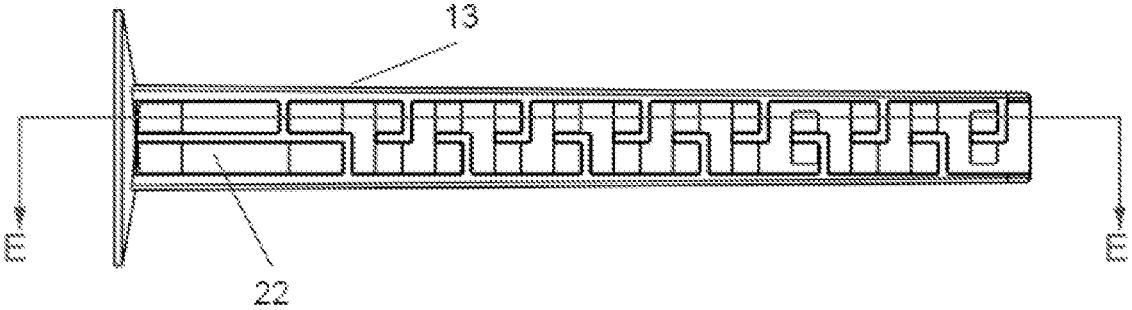
Figure 10B:
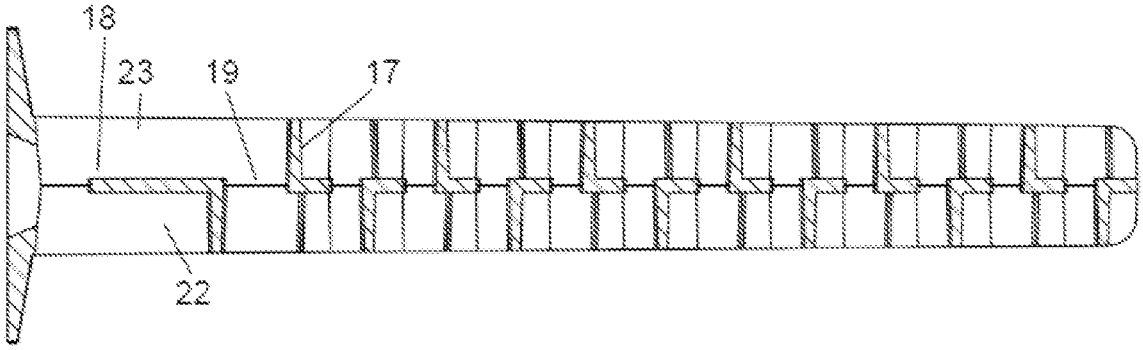

An eighth mixing element 2 is depicted in FIGS. 10*a* to 10*c*. Here, the reservoir chamber 22 has been reduced in comparison with the preceding embodiments in such a way that the through-opening 19 has been increased. Here, the cross-section of flow of the flow chamber 23 and of the through-opening 19 are equally sized. This leads in turn to the fact that the discharge pressure has been reduced in comparison with other embodiments.

Figure 11A:
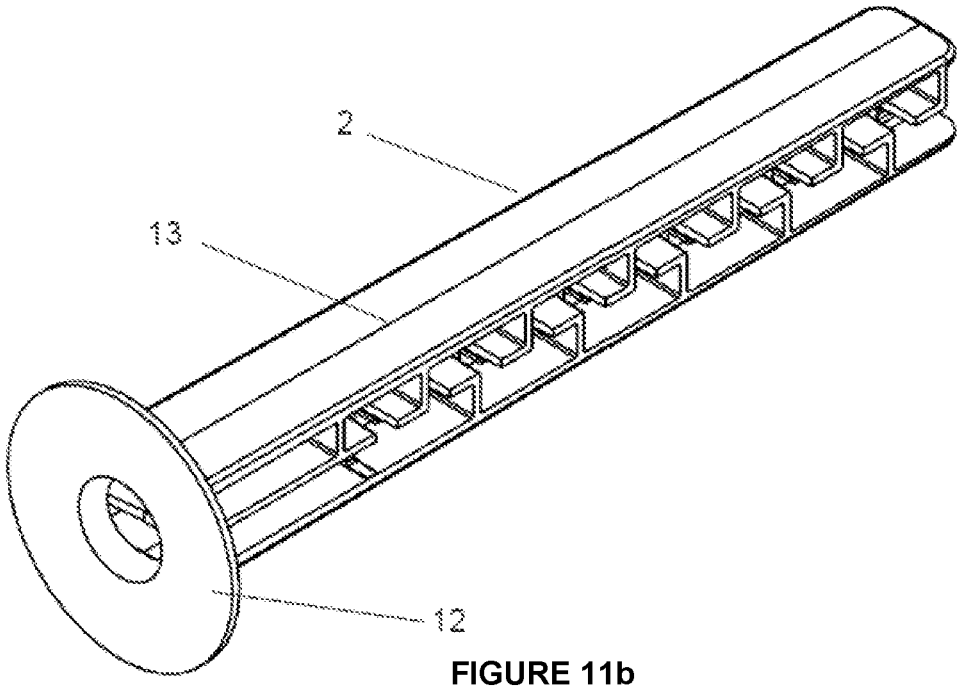
Figure 11B:
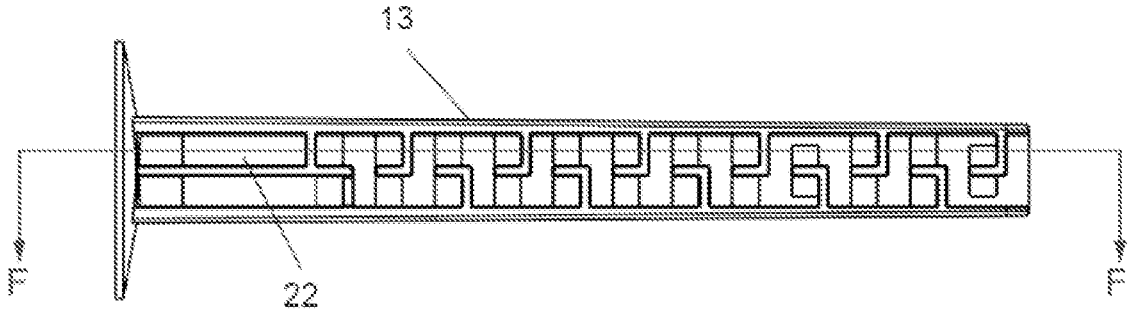
Figure 11B:
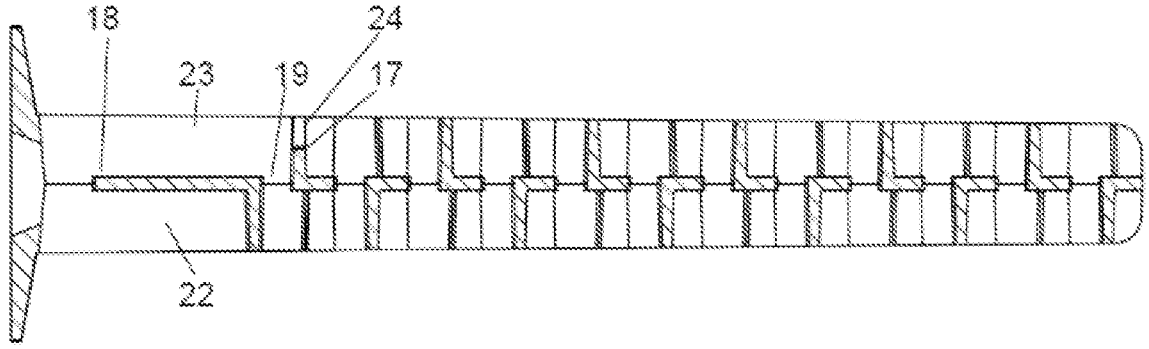

FIGS. 11*a* to 11*c* depict a ninth mixing element. Here, in a transverse wall 17 sealing the flow chamber 23, a transverse wall opening 24 was added in the direction of discharge of the material. This allows a portion of the components through the transverse wall opening 24 to flow directly into the adjoining mixing chamber, without the through-opening 19 having to be passed. Through that fact, the discharge pressure of the components is reduced, since a portion of this does not have to change its direction of flow in order to flow through the through-opening 19.

The invention claimed is:

1. A mixer for the mixing of pasty components, the mixer comprising:

a mixing case extending along a longitudinal axis, the mixing case including at least one inlet and an outlet, wherein at least one mixing element is accommodated in the mixing case, wherein the mixing element, together with the mixing case, defines a plurality of chambers positioned along a flow path from the at least one inlet to the outlet behind and/or next to one another, wherein the plurality of chambers are restricted by a plurality of transverse walls, each extending transversely to the longitudinal axis, as well as by a plurality of lateral walls, which each extend in parallel to the longitudinal axis, and wherein adjacent chambers of the plurality of chambers are flow-connected with one another via through-openings provided in the plurality of lateral walls, wherein the mixing element has two strips that are connected by a web forming a lateral wall of the plurality of lateral walls and positioned perpendicularly to the two strips, wherein a first group of chambers has first through-openings positioned in the web and extend up to the two strips, wherein a second group of chambers has second through-openings that are positioned at a distance from at least one of the two or more strips, wherein the mixing case has a first section rectangular in cross-section, in which the mixing element is accommodated, and has a second section circular in cross-section, at which the outlet is provided.

2. The mixer in accordance with claim 1, wherein the mixing case and the mixing element form a third group of at least one chamber, which is formed as a reservoir chamber with closed lateral walls and only one opening, which is formed as an input opening in a transverse wall.

3. The mixer in accordance with claim 2, wherein the reservoir chamber is provided on the inlet-side end of the mixing element.

4. The mixer in accordance with claim 2, wherein the mixing element has at least one flow chamber adjacent to the reservoir chamber, wherein the at least one flow chamber has at least one through-opening running in parallel to the web.

5. The mixer in accordance with claim 4, wherein the cross-section of the flow chamber positioned perpendicularly to the direction of discharge of the material amounts to 80% to 120% of the cross-section of the through-opening of the flow chamber.

6. The mixer in accordance with claim 4, wherein the flow chamber is restricted in the direction of discharge of the material by a transverse wall of the plurality of transverse walls, and that the transverse wall has a transverse wall opening.

7. The mixer in accordance with claim 2, wherein the cross-section of the mixing element positioned perpendicularly to the longitudinal axis in a section of the reservoir chamber and/or flow chamber amounts to 105% to 150% of the cross-section of the mixing element positioned perpendicularly to the longitudinal axis of a following section of the mixing element considered in the direction of discharge of the material.

8. The mixer in accordance with claim 1, wherein the web centrally connects the two strips.

9. The mixer in accordance with claim 1, wherein the plurality of transverse walls are connected with the web and one of the two strips, and the lateral wall of the plurality of lateral walls extend from the plurality of transverse walls in the direction of the inlets in parallel to the two strips.

10. The mixer in accordance with claim 1, wherein chambers of the first group and the chambers of the second group each have precisely four through-openings, from which two through-openings are formed in the web and two additional through-openings run in parallel to the web.

11. The mixer in accordance with claim 1, wherein the mixing case and the mixing element each form four chambers positioned in the cross-section next to one another, which are at least partially offset in relation to one another in the direction of the longitudinal axis.

12. The mixer in accordance with claim 1, wherein the mixing case has an inlet section, in which an insert, which has at least two studs forming the inlets, is fixed in a sealed manner, and is set freely rotatably with respect to the mixing case.

13. The mixer in accordance with claim 12, wherein the studs of the insert are flow-connected with the chambers by means of channels forming at least one compensation chamber and/or running at least partially radially inwardly.

14. The mixer in accordance with claim 1, wherein the chambers of the first group and the chambers of the second group, considered in the direction of discharge of the components, are positioned in the middle and/or upper area of the mixing element.

* * * * *